US005993363A

United States Patent [19]

Chen

[11] Patent Number: 5,993,363

[45] Date of Patent: Nov. 30, 1999

[54] EXERCISE MACHINE

[76] Inventor: Chih-Liang Chen, No. 10, Lane 1431, Kuanghsing Rd., Pateh City, Taoyuan Hsien, Taiwan

[21] Appl. No.: 09/176,668

[22] Filed: Oct. 21, 1998

[51] Int. Cl.[6] ..... A63B 21/04

[52] U.S. Cl. ..... 482/138; 482/130; 482/136; 482/137; 482/142

[58] Field of Search ..... 482/100, 112, 482/113, 130, 133, 136–138, 142; D21/676

[56] References Cited

U.S. PATENT DOCUMENTS 5,387,171 2/1995 Casey et al. ..... 482/130

5,743,832 4/1998 Sands et al. ..... 482/130

*Primary Examiner*—John Mulcahy

*Attorney, Agent, or Firm*—Jackson Walker L.L.P.

[57] ABSTRACT

An exercise machine includes a base having a seat fixed thereto and a backrest pivotal to a number of positions. A chest developing unit pivots with the lower portion of the backrest. The chest developing unit includes bilateral handles which are linked by a rack and pinion mechanism and resisted by an elastic band. A top exercise unit is mounted between horizontal supports extending from the top of the backrest. The top exercise unit is likewise resisted by elastic bands.

9 Claims, 8 Drawing Sheets

EXERCISE MACHINE

BACKGROUND OF THE INVENTION

1. Field of the Invention

The present invention relates to an exercise machine, and more specifically to an exercise machine with multiple fixtures and multiple functions enabling it to be operated in different ways by a user.

2. Description of Related Art

Exercise in-doors has become more and more prevalent in the modern society. An exercise machine that provides multiple functions to users is one of the most popular facilities for in-door exercise. The traditional exercise machine is either compact and simple in structure but limited in its capability or is very versatile with a large and complex structure.

SUMMARY OF THE INVENTION

The main object of the present invention is to provide a versatile multifunctional exercise machine, which enables a user to do many types of exercises such as lifts, curls and presses for all parts of the body.

A further object of the present invention is to provide an exercise machine with a compact structure that has multiple exercise fixtures and capabilities.

The detailed features of the present invention will be apparent in the detailed description with appropriate reference to the accompanying drawings.

DETAILED DESCRIPTION OF PREFERRED EMBODIMENT

Figure 1:
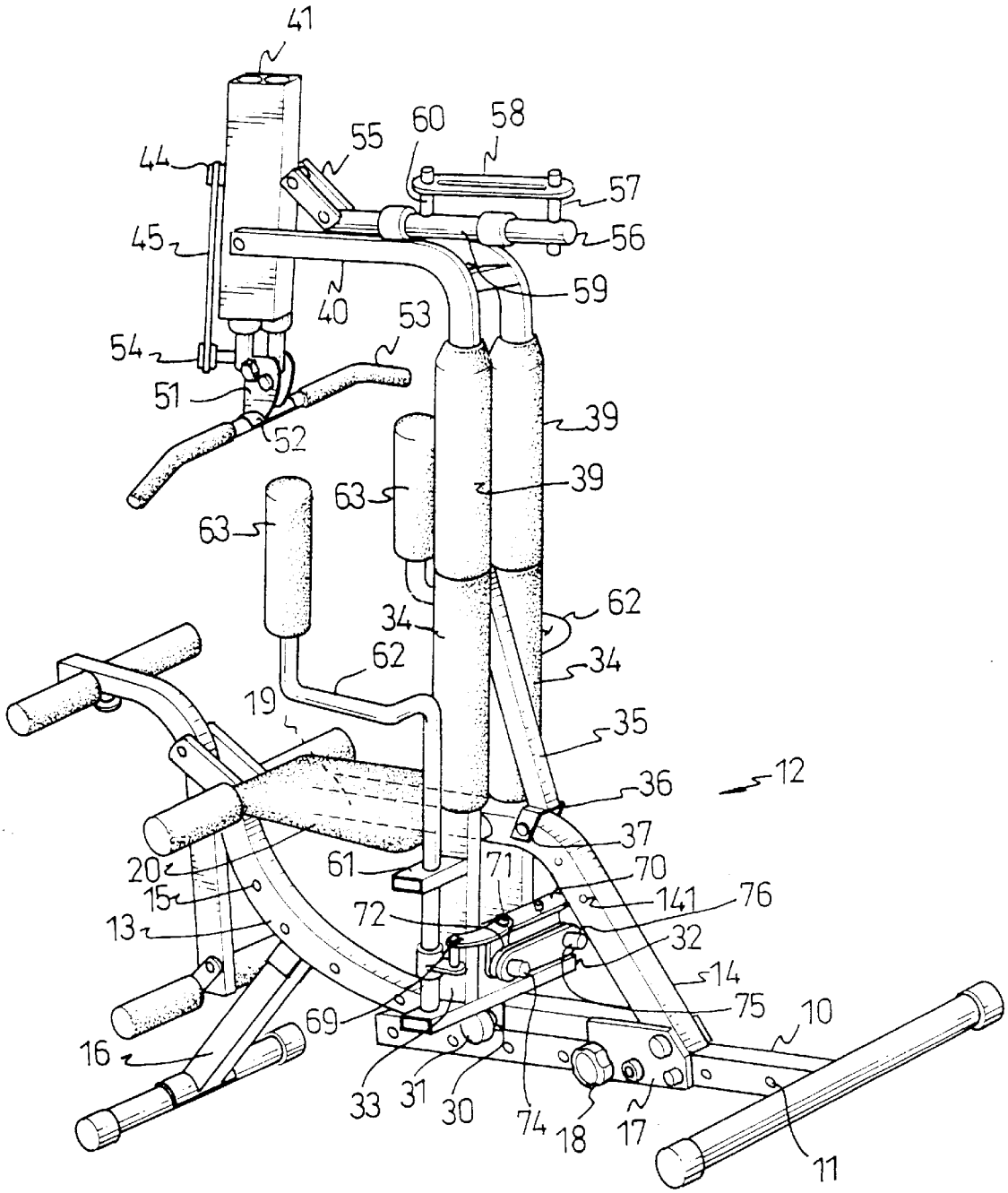
FIG. 1 is a perspective view of an exercise machine in accordance with the present invention.
Figure 2:
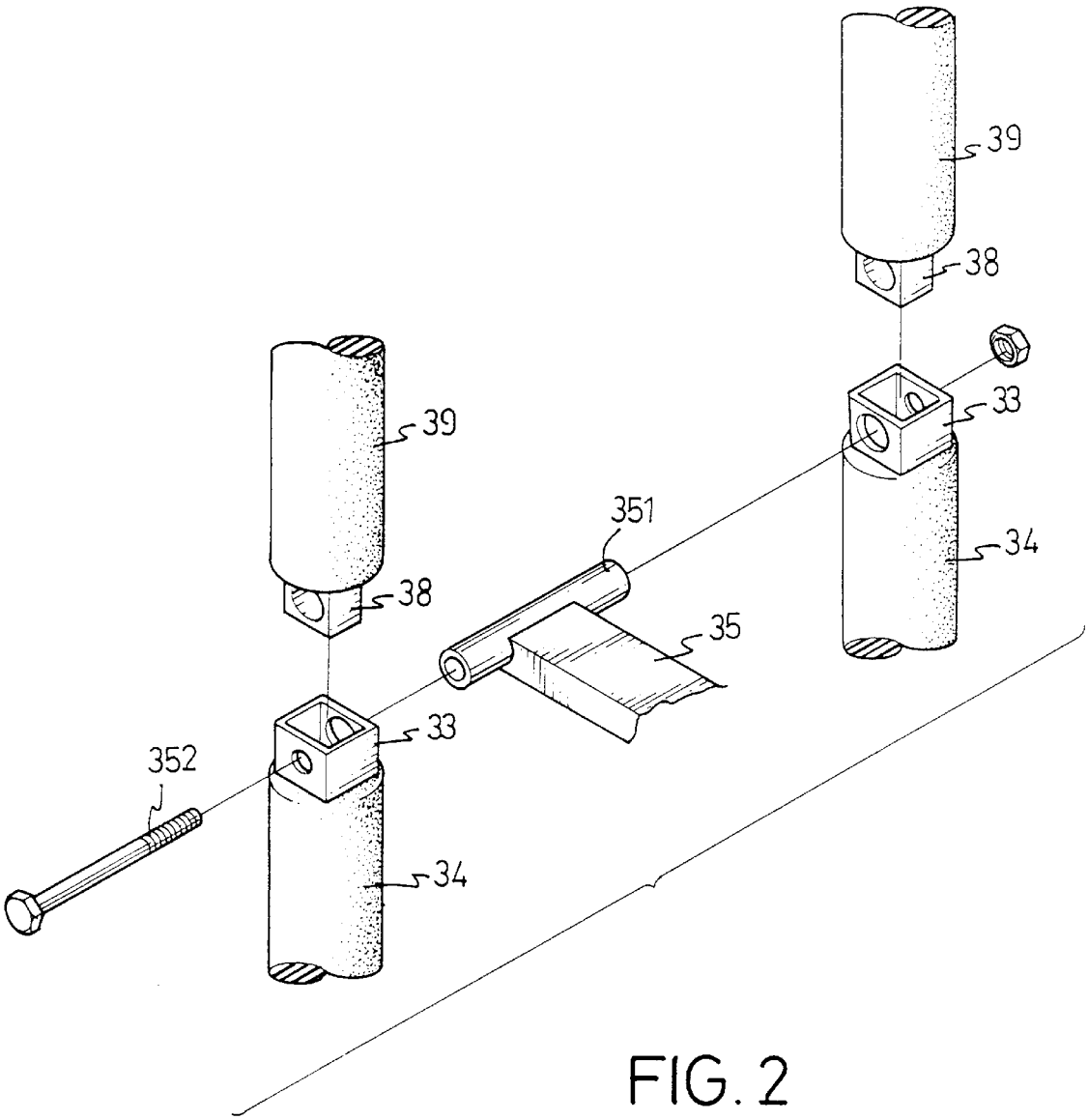
FIG. 2 is an partially exploded perspective view of the upper and lower union of the exercise machine shown in FIG. 1.
Figure 3:
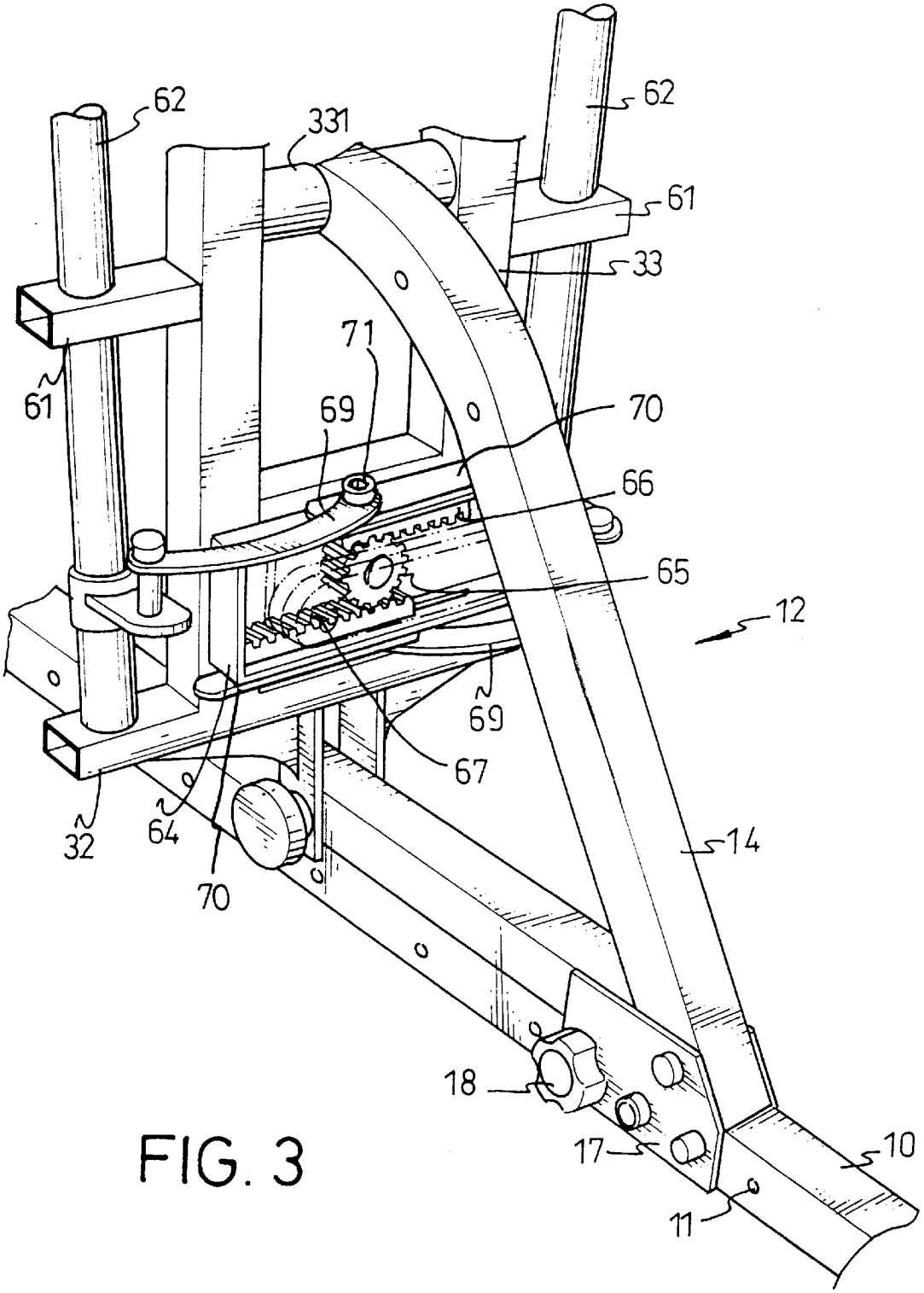
FIG. 3 is a partially cut away perspective view showing the gearbox of the exercise machine.

As illustrated in FIGS. 1, 2 and 3, an exercise machine according to the present invention comprises a T-shaped base (10), an upright frame (12), two parallel lower and upper supports (33,38), a chest developing unit and a top exercise unit.

The T-shaped base (10) is disposed on the ground and thereon disposed by the upright frame (12), which includes an arcuate beam (13), an inclined beam (14) and an horizontal beam (19) integral formed with the inclined beam (14) having a seat (20) disposed there on. The T-shaped base (10), the arcuate beam (13) and the inclined beam (14) define therein a plurality of holes (11, 15, 141) spaced apart from each other. A base support (16) is attached to the arcuate beam (13) to provide lateral stability to the exercise machine. Both sides of the lower end portion of the inclined beam (14) are connected with the base (10) by a joint plate (17) securely connected with the inclined beam (14) and selectively connected to the base (10) by a bolt (18), which is inserted through the joint plate (17) and one of the holes (11) of the base (10).

The two parallel lower supports (33) connect to the horizontal beam (19) between the two supports (33) on a pivot (331). Each of the two parallel upper supports (38) has the lower end detachably attached to one of the corresponding upper ends of the lower supports (33), and the upper end integrally forms a horizontal support (40). The upper portion of each of the lower supports (33) and the lower portion of the upper supports (38) are respectively enclosed in a sponge layer (34, 39) to protect and support the user's back.

Figure 4:
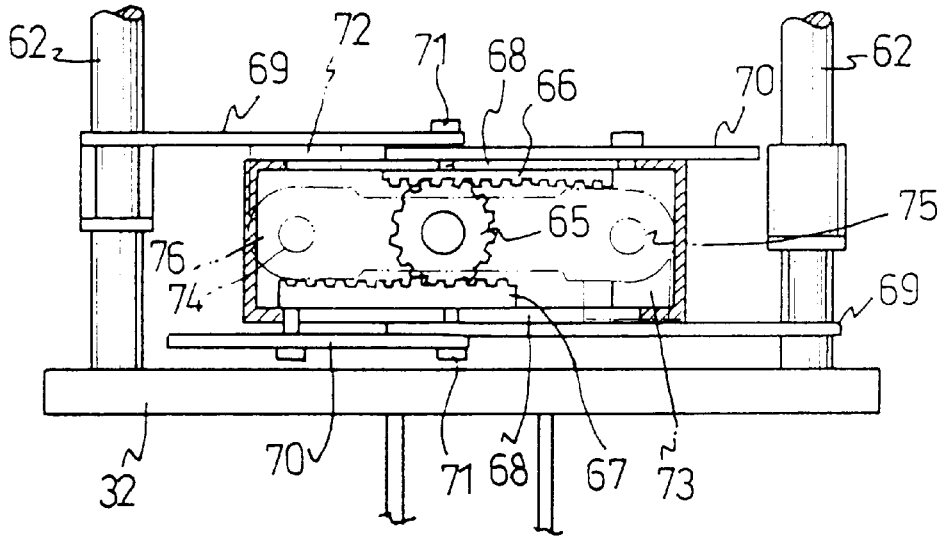
FIG. 4 is a partial cross section plan view of the gearbox shown in FIG. 3.

Furthermore, as shown in FIGS. 1, 3 and 4, two horizontal extended stands (61) are respectively formed on the external surface of the lower supports (33). Each stand (61) defines an upper aperture thereon; and a horizontal stand (32) securely attached to the lower end of the lower support (33) correspondingly define two lower apertures on the end portion thereof. Two substantially L-shaped handles (62) each have a lower portion extended through the corresponding upper and lower apertures of the stand (61) and the horizontal stand (32) and pivotally connected therewith, and each has an upper portion enclosed in a sponge layers (63) for the purpose of easily holding the handle.

Figure 5:
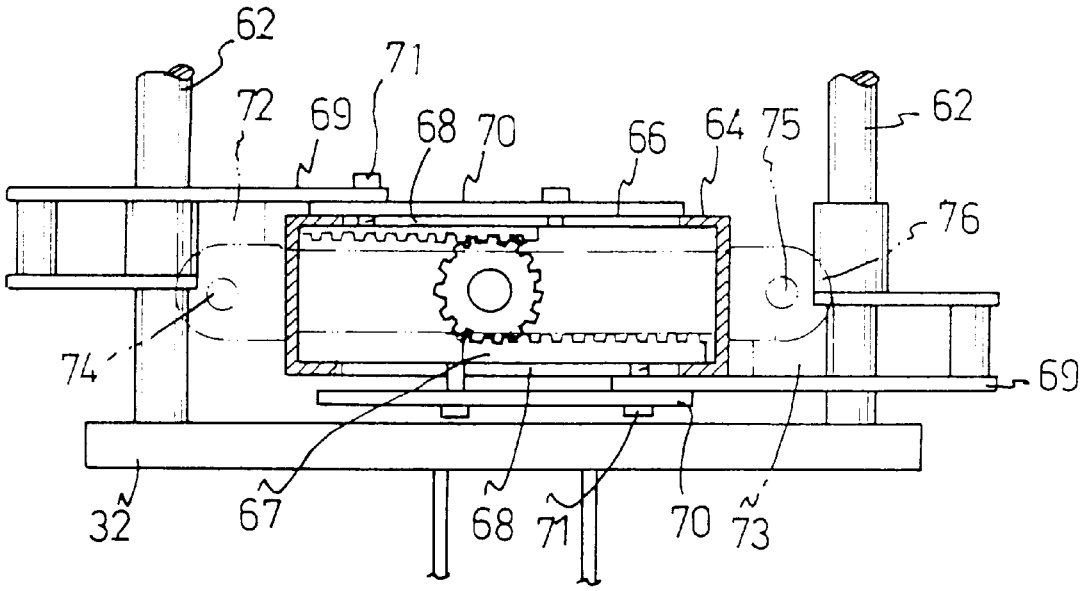
FIG. 5 is a plan view showing the operation of the elements in the gearbox.

As shown in FIGS. 3, 4 and 5, a gear box (64) is fixed between the two lower supports (33). A rack and pinion gear installed in the gear box (64) includes an upper rack (66) and a lower rack (67) between which a pinion gear (65) is engaged. Moreover, the top and bottom wall of the gear box (64) each have a slot (68) defined therein. Two connecting plates (70) are respectively fixed to the upper and lower racks (66, 67) by screws (71) through the slot (68). One end of the connecting plate (70) is pivotally connected to the corresponding first end of one of two link plates (69). The link plates (69) each has a second end respectively and pivotally connected to one of the corresponding two handles (62). As shown in FIGS. 1 and 4, two connecting members (72, 73) are respectively formed on the lateral edges of the link plates (69), each has a stud (74, 75) formed thereon. An elastic band (76) is installed around the studs (74,75) to provide a resistance force for the exerciser to overcome. It is noted that when the user is exercising with the two handles (62), the pivotal movement of the handles (62) will drive the link plates (69) to pivot in the same direction and the upper rack (66) and the lower rack (67) will be accordingly driven to move in opposite direction with respect to each other, which will expand the band (76), thereby achieving the purpose of exercise the user's muscles.

While the exerciser is pulling the handles (62) inward with respect to each other, as shown in FIG. 5, the handle (62) rotate causing the link plates (69) to be displaced outward in unison with the connecting member (72,73) and studs (74, 75) in unison to expend the elastic band (76). Then the restoring force of the elastic band (76) will cause the mechanism to return to its original position. In the fore said operation, the rack and pinion gearing mechanism synchronizes the driving effect on the handles (62).

Figure 6:
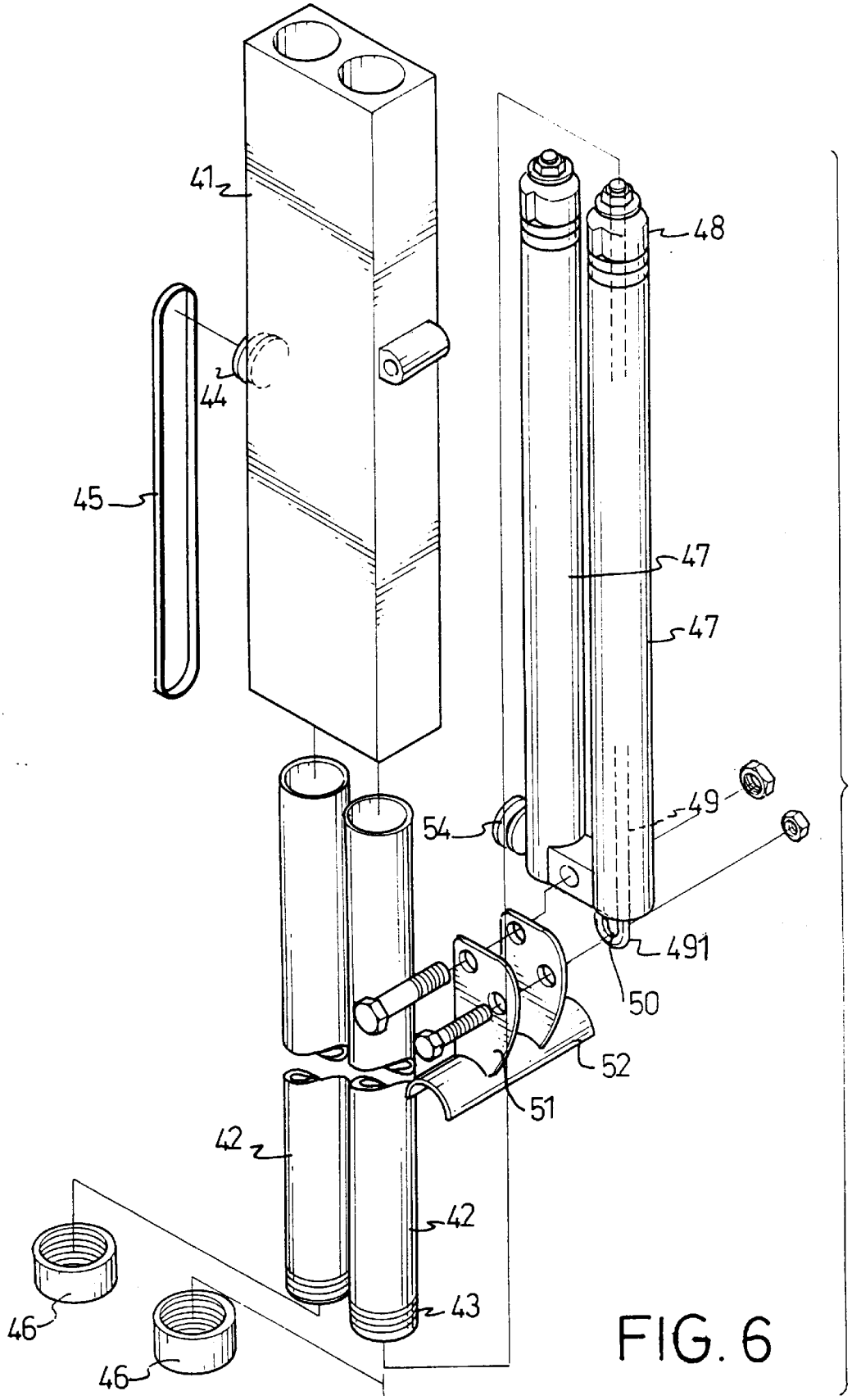
FIG. 6 is an exploded perspective view of the moving stand of the present invention.
Figure 7:
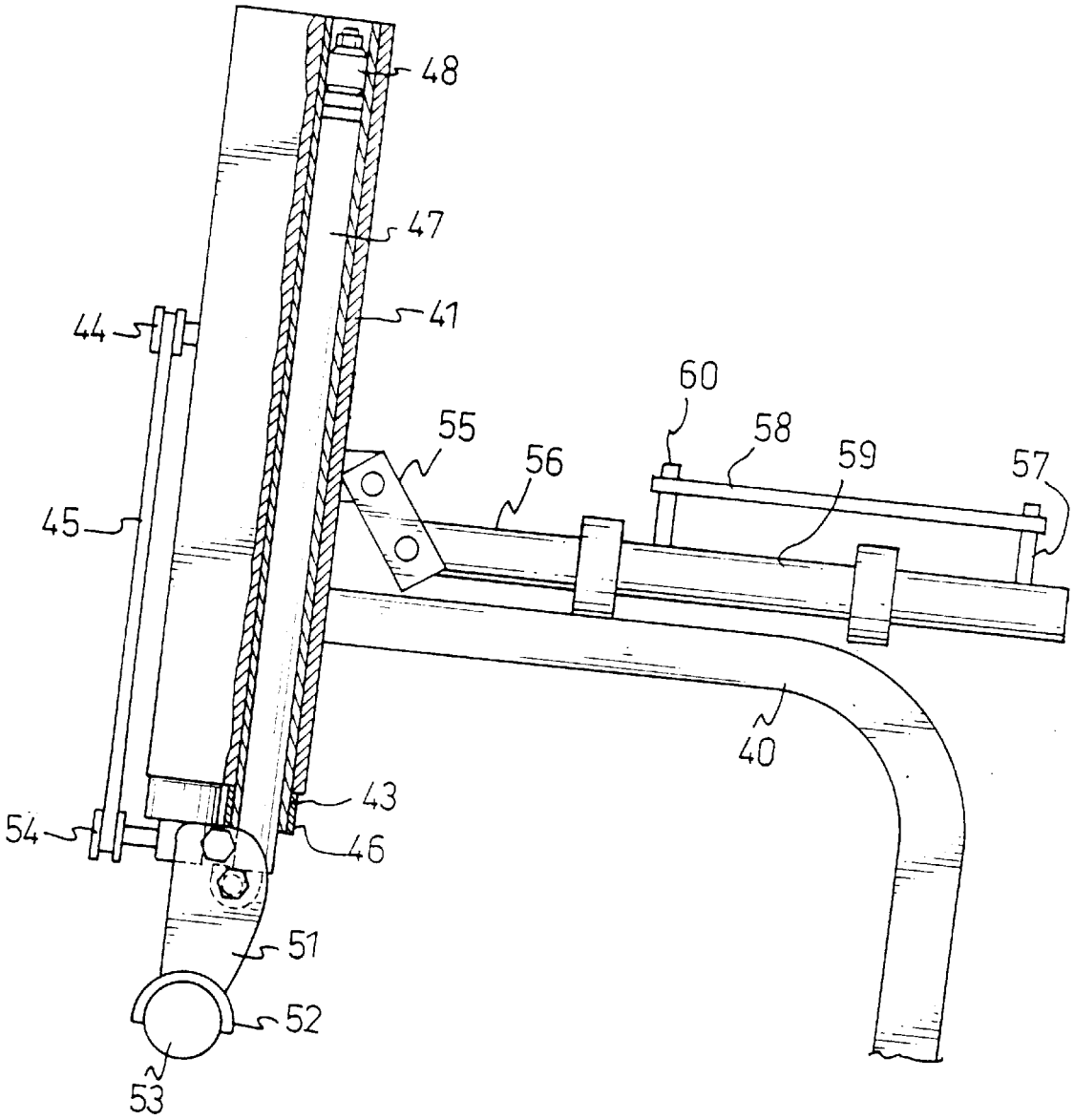
FIG. 7 is a partial sectioned schematic view showing the structure and relationship of the elements shown in FIG. 6.

As illustrated in FIGS. 1, 6 and 7, a moving stand (41) is mounted vertically between the two horizontal supports (40) pivotally connected therewith. Two sleeves (42) are received in the moving stand (41) each has a bottom end with external threads (43). The bottom ends of the sleeves (42) are then threadingly engaged with an inner threaded collar (46). Two hollow lifting rods (47) are respectively inserted into the two sleeves (42), each has an elastic bushing (48) attached on the top end thereof, and the two bottom ends of the lifting rods (47) are joined together by a link member. Wherein, a link rod (49) extends into one of two lifting rods (47) and the link rod (49) has a top end threadingly engaged with the elastic bushing (48) and an eye (491) formed at the bottom end. A connecting plate (51) has a top end portion pivotally connected to the eye (491) of the lifting rod (47), and the bottom end mounted with a joint piece (52), which is attached to the handle bar (53) therebeneath. An upper seat (44) is formed on the surface of the moving stand (41), and a lower seat (54) is formed on the surface of one of the lifting rods (47) corresponding to the upper seat (44). Then an elastic band (45) is installed between the upper seat (44) and the lower seat (54) to provide a restoring force to move the handlebar (53) to the "up" position.

Figure 8:
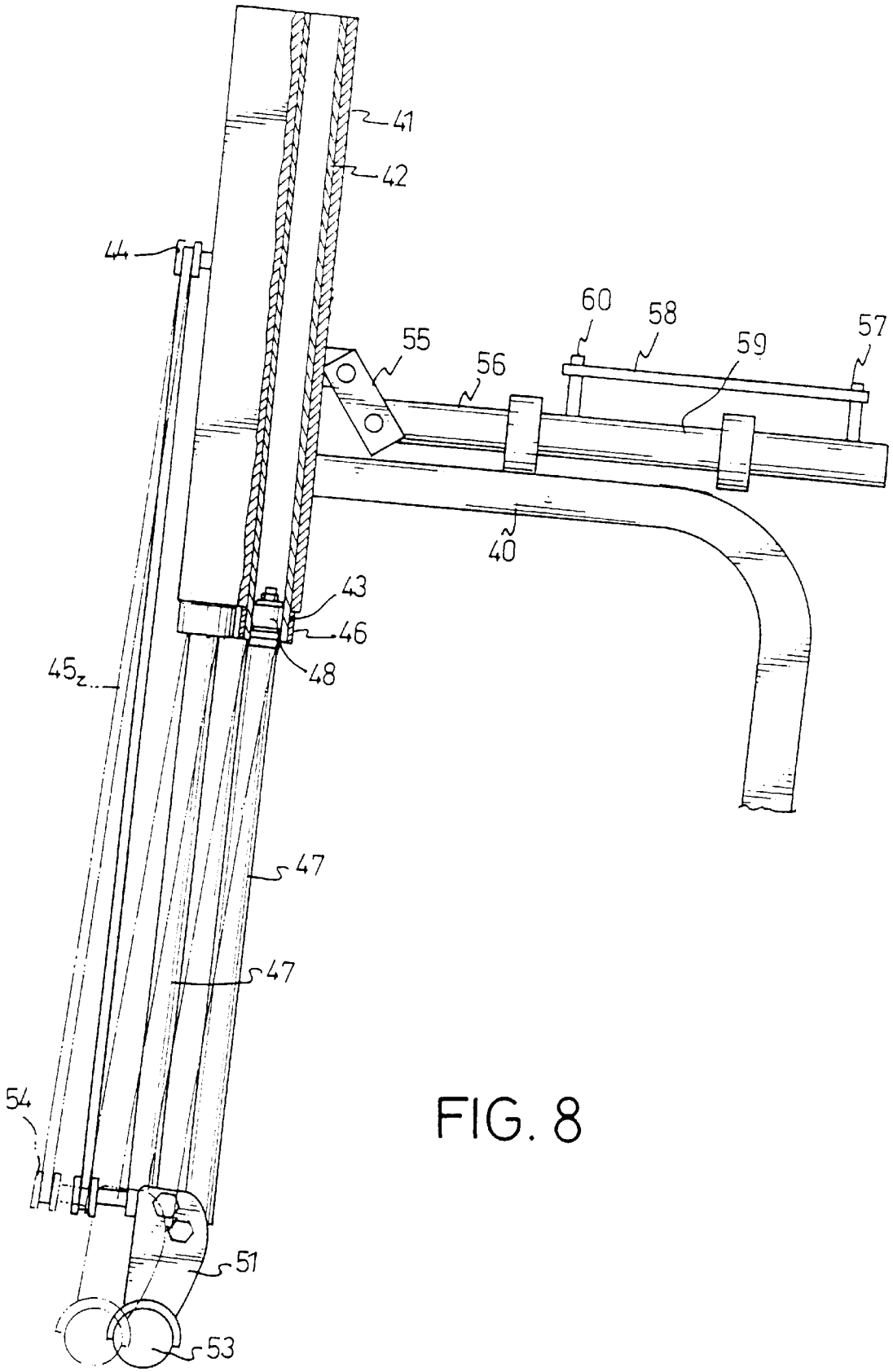
FIG. 8 is a partial sectioned schematic view showing the movement of the moving stand.

As shown in FIG. 8, when the lifting rod (47) is pulled down by a downward force on the handlebar (53), the elastic bushing (48) is deformed and seizes in the sleeve (42) or the collar (46) by a cross wise force so as to securely position the handle (53) in the desired position.

Figure 9:
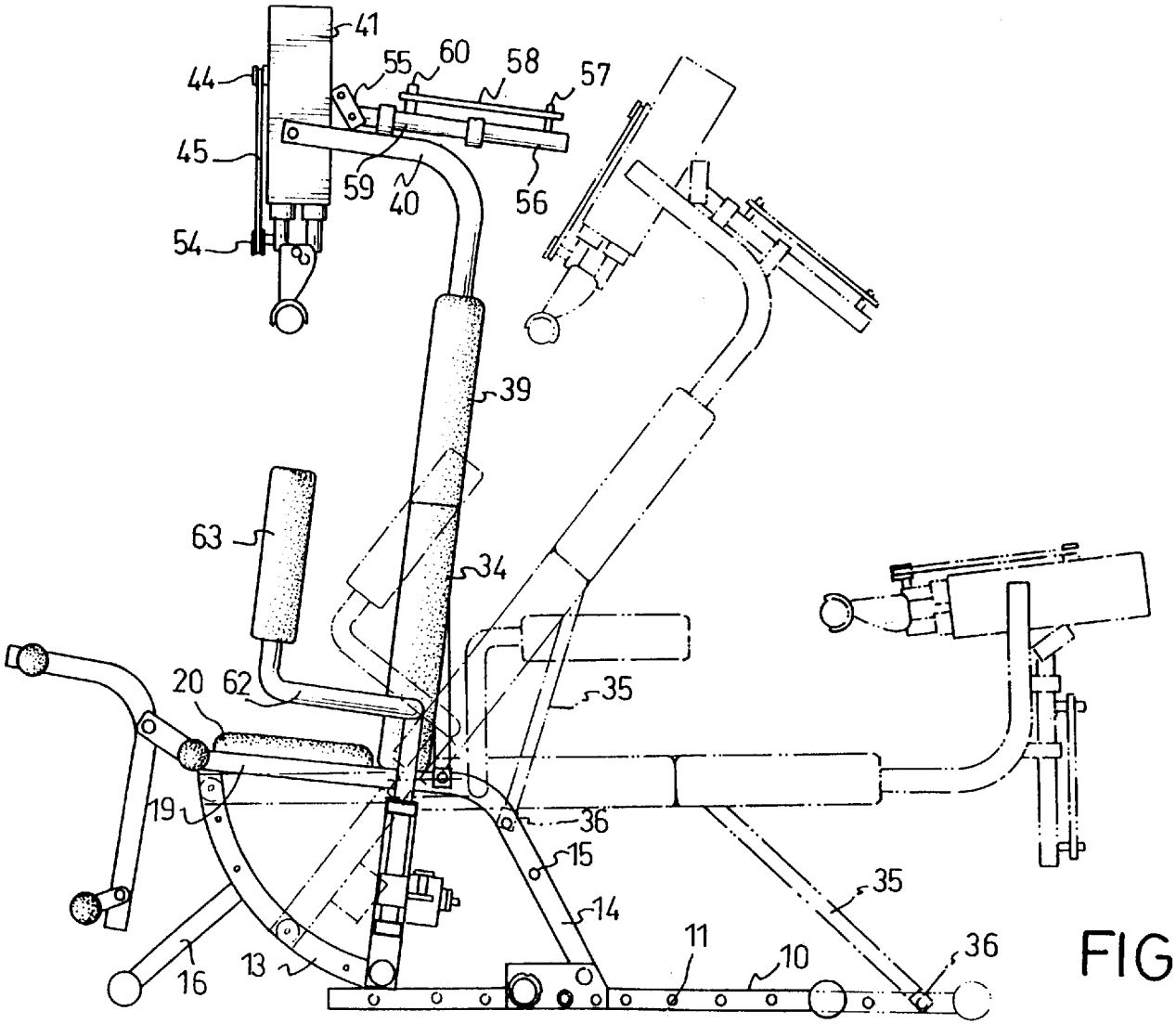
FIG. 9 is a schematic view showing the operation of the exercise machine at different angles.

As shown in FIGS. 1 and 9, a piston (56) cooperates with a cylinder (59) which is fixedly mounted on the horizontal support (40). The piston (56) has a first end pivotally connected to the first end of a link lever (55), and a second end inserted into the cylinder (59). The link lever (55) has a second end pivotally connected to the moving stand (41). A first stub (57) is formed on the second end portion of the piston (56), and a second stub (60) is formed on the cylinder (59). An elastic band (58) is installed around the first stub (57) and second stub (60) to provide a resistive force for the exerciser to overcome, thereby achieving the purpose of exercise the user's muscles.

The angular position of vertical components of the exercise machine with regard to the base is held in place by a U-shaped sliding member (30) mounted on the horizontal stand (32) attached to the arcuate beam (13) and an inclined support (35) attached between the inclined beam (14) and the joint of the upper and lower supports (38, 33). The sliding member (30) is able to slide along the arcuate beam (13) and be selectively fixed on the arcuate beam (13) by a bolt (31), which is inserted through the sliding member (30) and one of the holes (15) of the arcuate beam (13).

As shown in FIG. 2, the upper end of the inclined support (35) is fixedly attached to a horizontal hollow spindle (351) mounted to the joint between the upper and lower supports (39, 33) by a bolt (352) inserted through the top end portion of the lower supports(33) and the hollow spindle (351). The lower end of the inclined support (35) integrally forms or is provided with an inverted U-shaped sliding member (36). The sliding member (36) is able to slide along the inclined beam (14) and be fixed in place by a bolt (37) inserted through the sliding member (36) and one of the holes (141) of the inclined beam (14).

As illustrated in FIG. 9 the exercise machine according to the present invention is able to change its inclination from 0 to 90 degrees by adjusting the incline support (35) and the base (10) via choosing the desired one of the holes (11).

What is claimed is:

1. An exercise machine comprising:

a T-shaped base to be disposed on the ground;

an upright frame disposed on the base including an arcuate beam to be supported by a base support to the ground, an inclined beam and a horizontal beam integrally formed with the inclined beam and having a seat disposed thereon;

two parallel lower supports having lower ends selectively attached to positions along the arcuate beam, and intermediate portions pivotally connected to the horizontal beam;

two parallel upper supports, each of the two parallel upper supports having lower ends detachably attached to corresponding upper ends of the lower support, and upper ends integrally forming horizontal supports;

a chest developing unit mounted on the sides of the lower supports and connected with a driving mechanism; and a top exercise unit mounted between the horizontal supports.

2. The exercise machine in accordance with claim 1, wherein the T-shaped base, the arcuate beam and the inclined beam each defines therein a plurality of spaced holes.

3. The exercise machine in accordance with claim 2, wherein a horizontal stand is securely attached to the lower end of the lower support, and an inverted U-shaped slide member is mounted on the horizontal stand; the slide member is selectively attached on the arcuate beam by a bolt, which is inserted through the slide member and one hole of the arcuate beam.

4. An exercises machine in accordance with claim 3, wherein the chest developing unit comprises;

two horizontal extended stands respectively formed on bilateral external surfaces of the lower supports, each defining an upper aperture thereon; and the horizontal stand correspondingly defining two lower apertures on bilateral end portions thereof;

two L-shaped handles each having a lower portion extended through the corresponding upper and lower apertures and pivoting there with, and each having an upper portion enclosed in a sponge layer;

a gearbox fixed between the lower supports and having an upper rack, a lower rack movably received therein, and a pinion rotatably engaged with the upper and the lower rack and received therebetween, wherein top and bottom walls of the gear box each have a slot defined therein, and two connecting plates respectively fixed with the upper and lower rack by a screw through the slots;

two link rods having a first end respectively connected to a relative connecting plate, and a second end respectively and pivotally connected to the relative L-shaped handle;

two connecting members respectively formed on lateral edges of the link rod, each having one stub formed thereon with an elastic band being installed around the stubs.

5. The exercise machine in accordance with claim 2, wherein an inclined support is pivotally connected to the joint between the lower and upper supports, and has a lower end formed as an inverted U-shaped slide member able to slide along the inclined beam and the T-shaped base and be fixed by a bolt, which is inserted through the slide member and one hole of the inclined beam or the base.

6. The exercise machine in accordance with claim 1, wherein the upper portion of the lower support and the lower portion of the upper support are enclosed in a sponge layer.

7. The exercise machine in accordance with claim 2, wherein two sides of a lower end portion of the inclined beam are selectively mounted to a joint plate by a bolt, which is inserted through the joint plate and one of the holes of the base.

8. An exercise machine in accordance with claim 1, wherein the top exercise unit comprises;

a moving stand being disposed between the two horizontal supports, and pivotally connected there with;

two sleeves received in the moving stand, each having a bottom end threadly engaged by a collar;

two lifting rods being respectively inserted into the two sleeves, each having a top end threadly engaged by an elastic bushing, and bottom ends being joined with the other lifting rod by a link member;

a link rod inserted into one of the two lifting rods having a top end threadly engaged with the elastic bushing, and a bottom end being formed with an eye therein;

a connecting plate having a top end pivotally connected to the bottom end of the lifting rods, and a bottom end mounted with a joint piece which is attached by a handle bar there beneath;

an upper seat being formed on the surface of the moving stand, and a lower seat being formed on the surface of one of the lifting rods corresponding to the upper seat, an elastic band installed there around.

9. The exercise machine in accordance with claim 8, wherein a cylinder is fixedly mounted on the horizontal support; a piston has a first end pivotally connected to first end of a link lever that has a second end pivotally connected to the moving stand and a second end inserted through a cylinder; an elastic band being installed around two stubs which are respectively formed on second end portions of the piston and the cylinder.

* * * * *